United States Patent [19]

Shaver

[11] 4,291,811

[45] Sep. 29, 1981

[54] DISPLAY STAND

[76] Inventor: William A. Shaver, 3822 Palm Tree Blvd., Cape Coral, Fla. 33904

[21] Appl. No.: 36,520

[22] Filed: May 7, 1979

[51] Int. Cl.[3] ..... A47F 5/00

[52] U.S. Cl. ..... 211/205; 40/605; 211/169.1

[58] Field of Search ..... 211/205, 118, 169, 169.1, 211/113, 45; 40/605, 611, 606; 52/36, 239; 108/150

[56] References Cited

U.S. PATENT DOCUMENTS

| | | | |
|---|---|---|---|
| 709,171 | 9/1902 | Nussbaumer | 108/150 X |
| 723,114 | 3/1903 | Witt . | |
| 1,089,289 | 3/1914 | Thompson | 108/150 |
| 1,903,631 | 4/1933 | Morrison | 108/150 |
| 2,388,180 | 10/1945 | Pulver, Jr. | 40/606 |
| 2,865,124 | 12/1958 | Mortellito | 40/605 |
| 2,963,173 | 12/1960 | Barnes . | |
| 3,015,899 | 1/1962 | Ensign et al. | 40/611 X |
| 3,734,301 | 5/1973 | Rastocny | 211/205 |
| 3,756,422 | 9/1973 | Ostring et al. | 211/163 |
| 3,868,630 | 2/1975 | Lesondak | 40/606 X |

FOREIGN PATENT DOCUMENTS

| | | | |
|---|---|---|---|
| 1577525 | 6/1969 | France | 40/606 |

*Primary Examiner*—Roy D. Frazier
*Assistant Examiner*—Robert W. Gibson, Jr.
*Attorney, Agent, or Firm*—Benjamin P. Reese, II

[57] ABSTRACT

A display stand which is capable of assembly, disassembly and reassembly by unskilled persons without use of tools. The display stand is comprised of two horizontal members fitted together to form an "x" shaped base, two horizontal members fitted together to form an "x" shaped top, a central vertical support member which connects the base and the top at the center of the "x", four exterior vertical support members which connect the base and the top at the ends of the "x", and four display panels suspended from the arms of the "x" shaped top.

6 Claims, 2 Drawing Figures

DISPLAY STAND

BACKGROUND AND SUMMARY OF THE INVENTION

This invention relates to a portable display stand which may be used in museums, galleries and the like for displaying works of art and in hardware stores, super markets and the like for displaying goods and merchandise in pre-packaged form.

It has long been recognized that the structure used to display works of art can have a substantial impact on both the artistic and commercial success of an art exhibiton. And, of course, the structure used to display more mundane goods and merchandise is often the most important factor in the consumer's decision to purchase the particular goods and merchandise. Behavioral scientists teach us that this is true because the first step in every acceptance or buying decision which we make is a stimulation of our senses to create an awareness of the availability of a possible better situation. An attractive display is known to have a stimulating effect on our sense of sight.

The known structures for displaying works of art and other goods and merchandise are almost too numerous to be discussed. A large number of different types of display stands are available from commercial sources. Many of the commercially available display stands are described in Sweet's Catalogue File: Architectural Products for General Building and other standard reference books used by the building, merchandising and decorating trades. The display stands described in such reference books are only illustrative of the types of structures which are available for display purposes since many display stands are manufactured by small businesses which do not market their products nationally.

It is possible to use many of the commercially available display stands to attractively display works of art and other goods and merchandise. However, only a relatively small number of known structures which can be used to attractively display works of art and other goods and merchandise are capable of being disassembled for transport and storage and reassembled when needed for display purposes. And, only a relatively small number of those structures can be disassembled and reassembled quickly and easily without the use of tools. U.S. Pat. No. 2,963,173 and U.S. Pat. No. 3,756,422 disclose structures which are capable of assembly, disassembly and reassembly without the use of tools. But, these structures have significant disadvantages which limit their use as portable display stands, including the tendency to fall over if accidentally struck or bumped by a passerby.

The present invention provides a display stand which can be assembled for display purposes, disassembled for storage and transport and reassembled when subsequently needed for display purposes. An unskilled person can quickly and easily perform all operations necessary for assembly, disassembly and reassembly of the display stand of the present invention without the use of tools. The assembled structure provides a very attractive multi-panel display stand which does not fall over when accidentally struck or bumped by a passerby. Yet, when disassembled, the structure occupies considerably less space than would be the case with known multi-panel display stands.

The display stand of the present invention is comprised of a structural frame having display panels suspended therefrom. The structural frame is comprised of two horizontal members fitted together to form an x-shaped base, two horizontal members fitted together to form an x-shaped top, a central vertical support member which connects the base and the top at the center of the "x" and functions as a center post, and four exterior vertical support members which connect the base and the top at the ends of the "x". The horizontal members and the central vertical support member are appropriately slotted for fitting together in the desired shape. Conventional screw fastening means are used to connect the exterior vertical support members to the base and the top at the end of the "x".

Various commercially available display panels can be suspended from the structural frame of the present invention to complete assembly of the display stand. Conventional peg board is suitable for most routine display situations. Display panels covered with textured fabrics or other special display panels are desirable for display situations in which aesthetic considerations are paramount.

These and many other advantages and features of the present invention will be apparent from the following description of drawings, description of the preferred embodiment and the appended claims.

DESCRIPTION OF PREFERRED EMBODIMENT

Figure 1:
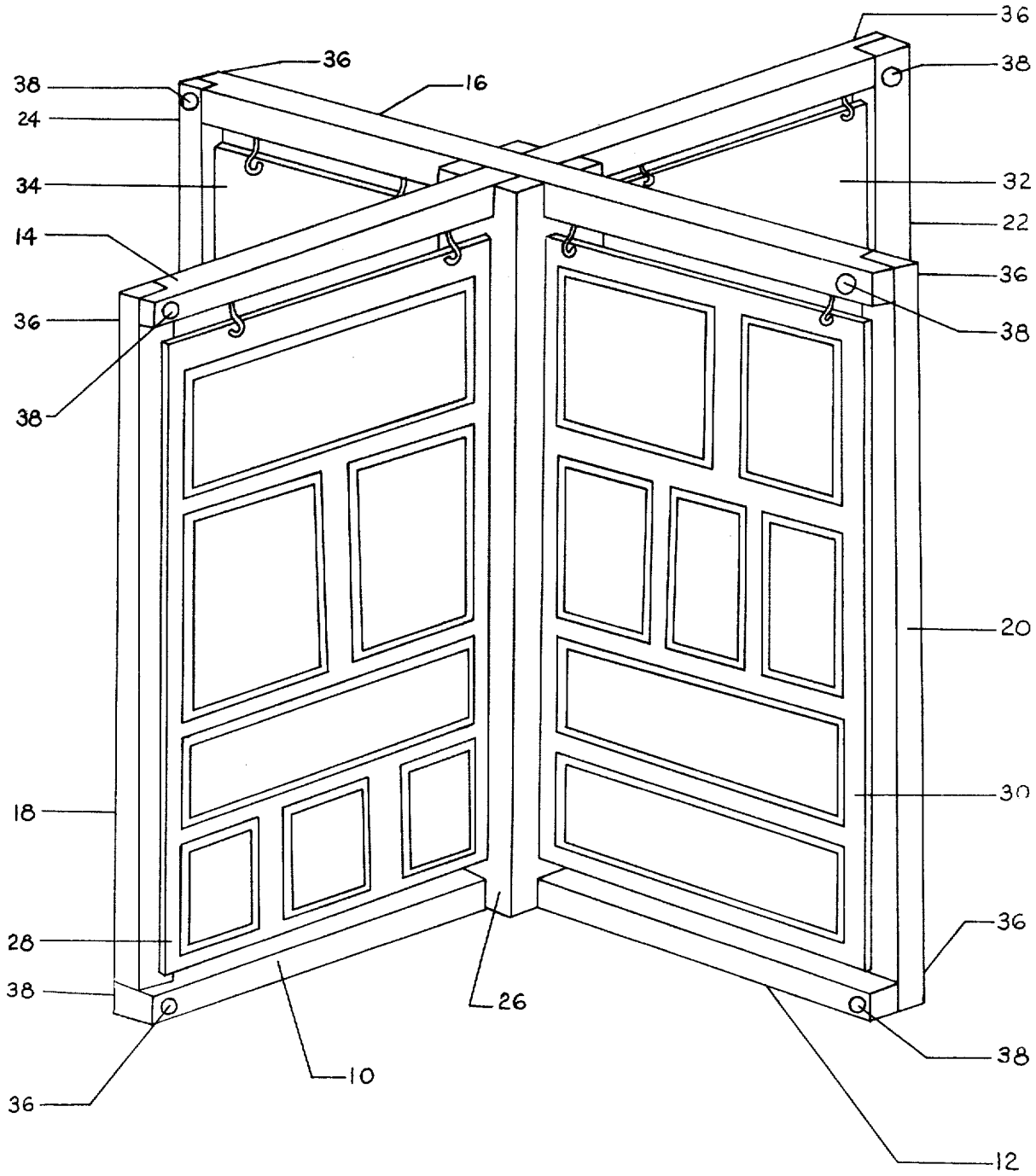
FIG. 1 is a perspective view showing the display stand of the present invention with works of art displayed on two display panels.
Figure 2:
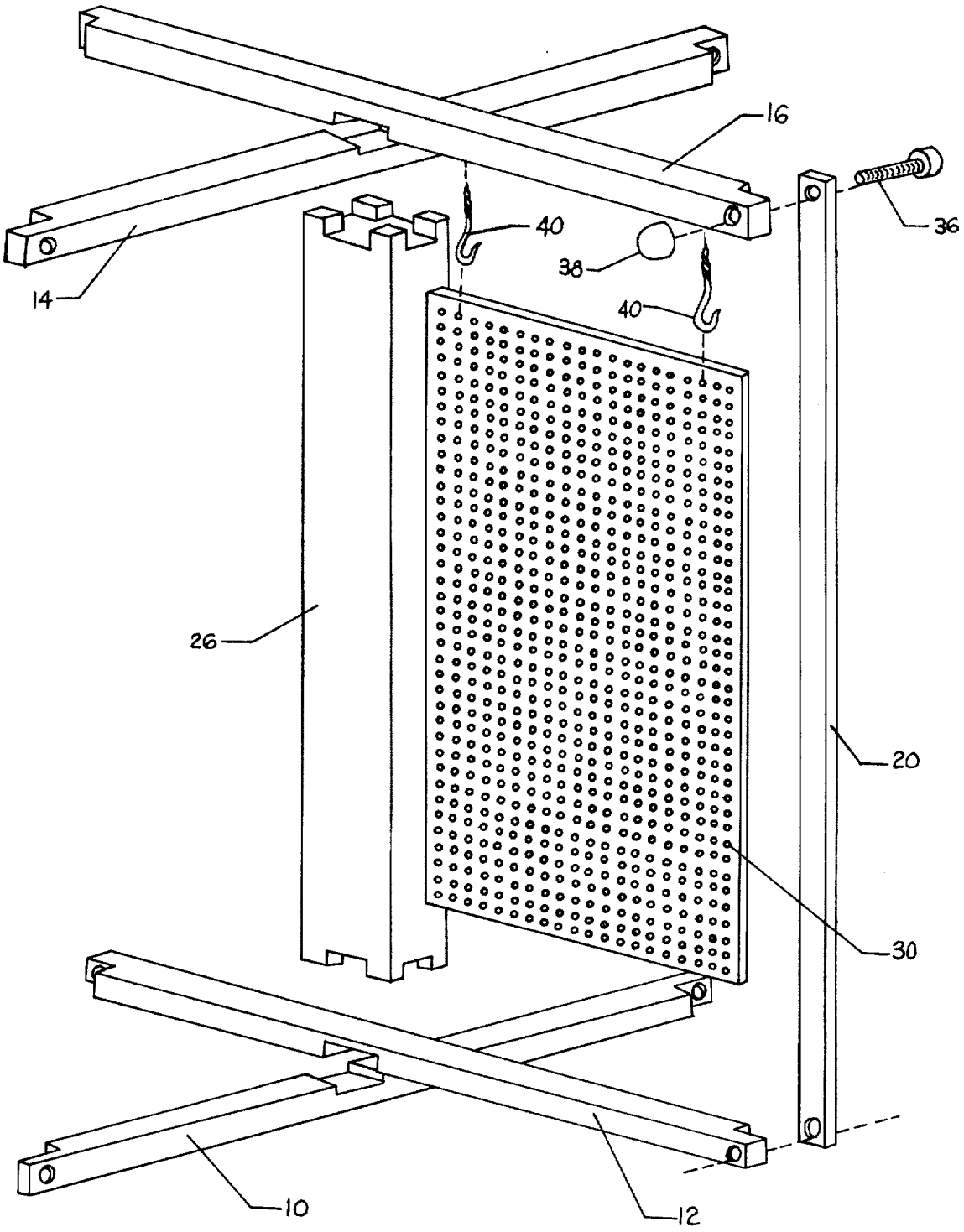
FIG. 2 is an exploded perspective view illustrating the manner in which the display stand of the present invention is assembled.

The preferred embodiment of the display stand of the present invention is illustrated in FIGS. 1 and 2. The assembled display stand illustrated in FIG. 1 is comprised of a structural frame having display panels suspended therefrom.

The structural frame is comprised of nine structural members, namely, horizontal members 10, 12, 14 and 16, exterior vertical support members 18, 20, 22 and 24, and central vertical support member 26. These structural members can be manufactured from commercially available wooden, metal and plastic materials. The ideal material for manufacture of these members would have the necessary physical strength, would be lightweight, and would be attractive to the eye.

In the preferred embodiment, members 10, 12, 14 and 16 are each a rectangular solid with minor modifications to the basic shape. Each of these members has a latitudinal slot at the center of one longitudinal face of the rectangular solid. The latitudinal slot in horizontal member 10 and the latitudinal slot in horizontal member 12 are fitted together to form an x-shaped base for the display stand. The latitudinal slot in horizontal member 14 and the latitudinal slot in horizontal member 16 are fitted together to form an x-shaped top for the display stand.

Central vertical support member 26 is a rectangular solid with a cross-configured pair of slots in each end face. The cross-configured slots on one end face of central vertical support member 26 cooperate with the center location of the "x" created by fitting together horizontal member 10 and horizontal member 12 and the cross-configured slots on the other end face of central vertical support member 26 cooperate with the center location of the "x" created by fitting together horizontal member 14 and horizontal member 16. In this manner, it can readily be seen by one skilled in the art that central vertical support member 26 functions as a center post for the structural frame.

It should be readily apparent to one skilled in the art that only the above-described members are necessary to complete the structural frame if "forced fit" assembly is used. Furthermore, only these structural members would be necessary if suitable fastening means are utilized at the intersection of horizontal member 10, horizontal member 12 and central vertical support member 26 and at the intersection of horizontal member 14, horizontal member 16 and central vertical support member 26. While either of these two alternatives can be used with the structural frame, it is preferable not to use fastening means at these intersections for easier assembly and disassembly of the structural frame. In like manner, it is preferable to use relatively "loose fitting" tolerances.

In the preferred embodiment, a latitudinal cylindrical hole is provided near each end of horizontal members 10, 12, 14 and 16. Exterior vertical support member 18 is fastened to one end of horizontal member 10 and to one end of horizontal member 14 with suitable screw fastening means; exterior vertical support member 20 is fastened to one end of horizontal member 12 and to one end of horizontal member 16 with suitable screw fastening means; exterior vertical support member 22 is fastened to one end of horizontal member 10 and to one end of horizontal member 14 with suitable screw fastening means; and exterior vertical support member 24 is fastened to one end of horizontal member 12 and to one end of horizontal member 16 with suitable screw fastening means. It can be readily appreciated by one skilled in the art that this creates a strong structural frame which can be quickly and easily assembled, disassembled and reassembled by an unskilled person without using tools.

Eight each of headed bolt 36 and nut 38 are used as screw fastening means for attachment of exterior vertical support members 18, 20, 22 and 24 to the structural frame. For aesthetic reasons, headed bolts and nuts having a decorative appearance, such as bolts having hemispherically-shaped heads and hemispherically-shaped nuts, are preferred. Various decorative headed bolts and nuts are commercially available.

In the preferred embodiment, four each of suspension hook 40 are fastened to horizontal member 14 and four each of suspension hook 40 are fastened to horizontal member 16 by conventional means. The suspension hooks illustrated in FIG. 2 are of the conventional type having screw threads on the shank. These hooks are suitable when wooden materials are used for the structural frame. Display panels 28, 30, 32 and 34 are suspended from said suspension hooks to complete assembly of the display stand.

FIGS. 1 and 2 illustrate the use of conventional peg board for display panels 28, 30, 32 and 34. If peg board is used, commercially available hooks for cooperation with the holes in the peg board can be used as a means for fastening works of art or other goods and merchandise to the display panels. FIG. 1 illustrates an arrangement of various works of art attached to display panels 28 and 30. Of course, it can be readily appreciated by one skilled in the art that several smaller display panels could be interconnected by conventional means, such as suspension hooks, and substituted for one or more of display panels 28, 30, 32 and 34 and works or art or other goods and merchandise attached thereto in the manner described.

Many commercially available materials are suitable for use as display panels. Accordingly, the display stand of the present invention is not limited to display stands which use peg board display panels. For example, display panels covered with textured fabrics are desirable for many display situations. When such display panels are used, commercially available fastening means which adhere to the fabric are used to attach works of art or other goods and merchandise to the display panels.

It can be readily appreciated by one skilled in the art that the display stand illustrated in FIGS. 1 and 2 can be used for various other purposes by appropriate substitutions of alternative elements for display panels 28, 30, 32 and 34. For example, suitable sound reducing panels can be substituted for said display panels and the resulting structure can be used as a temporary partition for school rooms, hospital rooms, meeting rooms, offices and the like.

While the present invention has been disclosed in connection with the preferred embodiment thereof, it should be understood that there may be other embodiments which fall within the spirit and scope of the invention as defined by the following claims:

I claim:

1. A display stand, comprising:

(a) an x-shaped base; p1 (b) an x-shaped top; p1 (c) a rectangular solid central vertical support member having cross-configured slots in each end, one end of which cooperates with the center of said x-shaped base and the other end of which cooperates with the center of said x-shaped top; and (d) four display panels suspended from said x-shaped top.

2. A display stand, comprising:

(a) two horizontal members fitted together to form an x-shaped base;

(b) two horizontal members fitted together to form an x-shaped top;

(c) a central vertical support member connecting said x-shaped base and said x-shaped top at the center of the "x";

(d) four exterior vertical support members connecting said x-shaped base and said x-shaped top at the ends of the "x"; and (e) four display panels suspended from said x-shaped top.

3. A display stand as recited in claim 2, wherein each of said horizontal members is a rectangular solid having a latitudinal slot at the center of one longitudinal face which cooperates with the latitudinal slot at the center of one longitudinal face of the other.

4. A display stand, comprising:

(a) two rectangular solid horizontal members, each having a latitudinal slot at the center of one longitudinal face, which fit together to form an x-shaped base;

(b) two rectangular solid horizontal members, each having a latitudinal slot at the center of one longitudinal face, which fit together to form an x-shaped top;

(c) a rectangular solid central vertical support member having cross-configured slots in each end, one end of which cooperates with the center of said x-shaped base and the other end of which cooperates with the center of said x-shaped top;

(d) four exterior vertical support members connecting said x-shaped base and said x-shaped top at the ends of the "x"; and (e) four display panels suspended from said x-shaped top.

5. A display stand as recited in claim 4, wherein each of said rectangular solid vertical support members has a latitudinal cylindrical hole near each end thereof and each of said exterior vertical support members has a latitudinal cylindrical hole near each end thereof, said holes being provided for connection of said members by screw fastening means.

6. A display stand as recited in claim 5, wherein each of said screw fastening means is a headed bolt and a nut.

* * * * *